US006152296A

United States Patent [19]

Shih

[11] Patent Number: 6,152,296

[45] Date of Patent: Nov. 28, 2000

[54] ADDITIVE HOLDER FOR A PET BOTTLE

[76] Inventor: Kuang-Sheng Shih, P.O. Box 82-144, Taipei, Taiwan

[21] Appl. No.: 09/186,615

[22] Filed: Nov. 6, 1998

[51] Int. Cl.[7] ..... B65D 1/02; B65D 23/12; B65D 25/08

[52] U.S. Cl. ..... 206/222; 215/10; 215/DIG. 8; 222/129

[58] Field of Search ..... 215/10, DIG. 8; 206/222; 222/129

[56] References Cited

U.S. PATENT DOCUMENTS

| | | | |
|---|---|---|---|
| 3,156,369 | 11/1964 | Bowes et al. | 215/DIG. 8 X |
| 3,715,189 | 2/1973 | Nighohossian et al. | 206/222 X |
| 3,968,872 | 7/1976 | Cavazza | 206/222 |
| 4,221,291 | 9/1980 | Hunt | 215/DIG. 8 X |
| 4,682,689 | 7/1987 | Pereira et al. | 215/DIG. 8 X |
| 4,903,865 | 2/1990 | Janowitz | 206/222 X |
| 5,186,323 | 2/1993 | Pfleger | 215/DIG. 8 |

*Primary Examiner*—Sue A. Weaver
*Attorney, Agent, or Firm*—A & J

[57] ABSTRACT

An additive holder for a PET bottle includes a tubular member having an open top formed with a flange and an open bottom formed with a toothed neck, the tubular member being fitted in the externally threaded mouth with the flange resting on an upper edge of the mouth, the tubular member having an inner side formed with a circular protrusion, a container having an upwardly extending handle and fitted inside the tubular member and kept in place by the circular protrusion, with the handle extending upwardly out of the tubular member, a locking cap provided with internal threaded engageable with the externally threaded mouth and having an axial through hole receiving the handle of the container, and a cover engageable with a top of the locking cap, whereby an additive such as sugar, cream milk, or the like in the container will drop down to mix with a drink in the PET bottle as desired.

1 Claim, 6 Drawing Sheets

ADDITIVE HOLDER FOR A PET BOTTLE

BACKGROUND OF THE INVENTION

1. Field of the Invention

This invention is related to an additive holder for a PET bottle.

2. Description of the Prior Art

The convention PET bottle is designed for receiving a drink with a particular taste only and so it is impossible to adjust the taste thereby failing to meet everyone's appetite.

Therefore, it is an object of the present invention to provide an additive holder for a PET bottle which enables an additive such as sugar, cream milk, or the like to mix with a drink in the PET bottle as desired.

SUMMARY OF THE INVENTION

This invention is related to an additive holder for a PET bottle.

According to a preferred embodiment of the present invention, an additive holder for a PET bottle includes a tubular member having an open top formed with a flange and an open bottom formed with a toothed neck, the tubular member being fitted in the externally threaded mouth with the flange resting on an upper edge of the mouth, the tubular member having an inner side formed with a circular protrusion, a container having an upwardly extending handle and fitted inside the tubular member and kept in place by the circular protrusion, with the handle extending upwardly out of the tubular member, a locking cap provided with internal threaded engageable with the externally threaded mouth and having an axial through hole receiving the handle of the container, and a cover engageable with a top of the locking cap.

It is the primary object of the present invention to provide an additive holder for a PET bottle which enables an additive such as sugar, cream milk, or the like to mix with a drink in a PET bottle as desired.

It is another object of the present invention to provide an additive holder which can be easily mounted in in a PET bottle.

It is still another object of the present invention to provide an additive holder for a PET bottle which is simple in construction.

It is still another object of the present invention to provide an additive holder for a PET bottle which is fit for practical use.

It is a further object of the present invention to provide an additive holder for a PET bottle which is low in cost.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
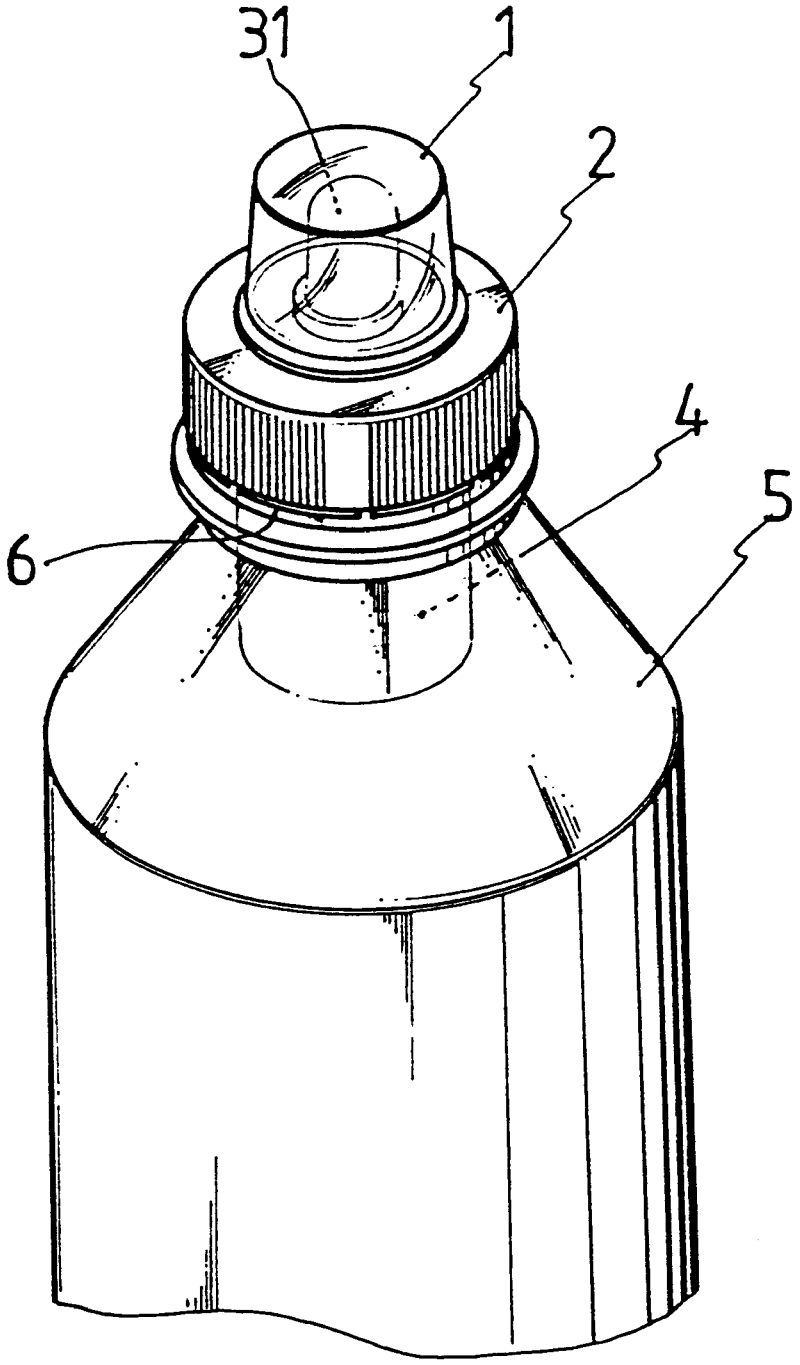
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
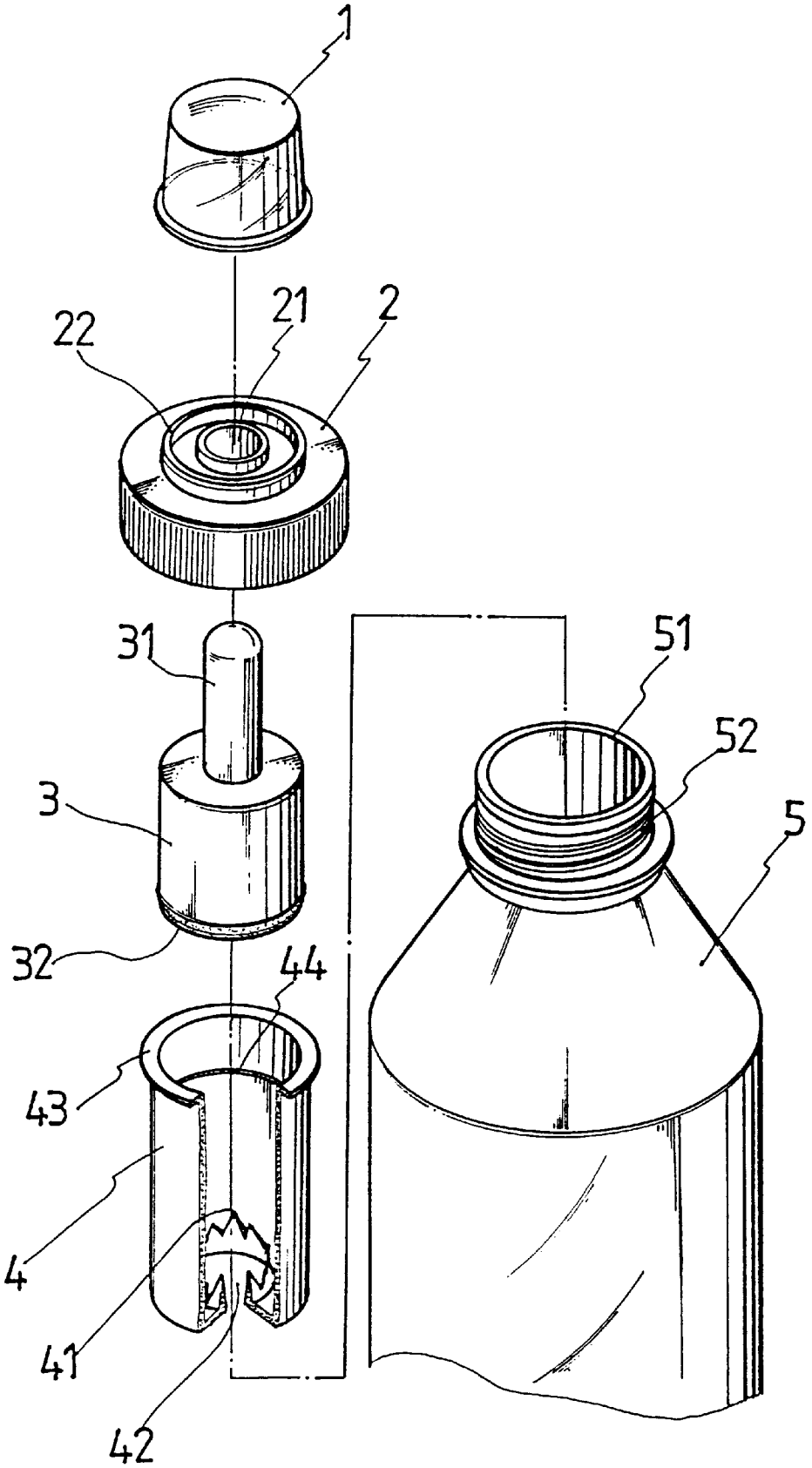
FIG. 2 is an exploded view of the present invention.

With reference to the drawings and in particular to FIGS. 1 and 2 thereof, the present invention generally comprises a cover 1, a locking cap 2, a container 3, and a tubular member 4. The present invention is designed to be engaged with a PET bottle.

Figure 3:
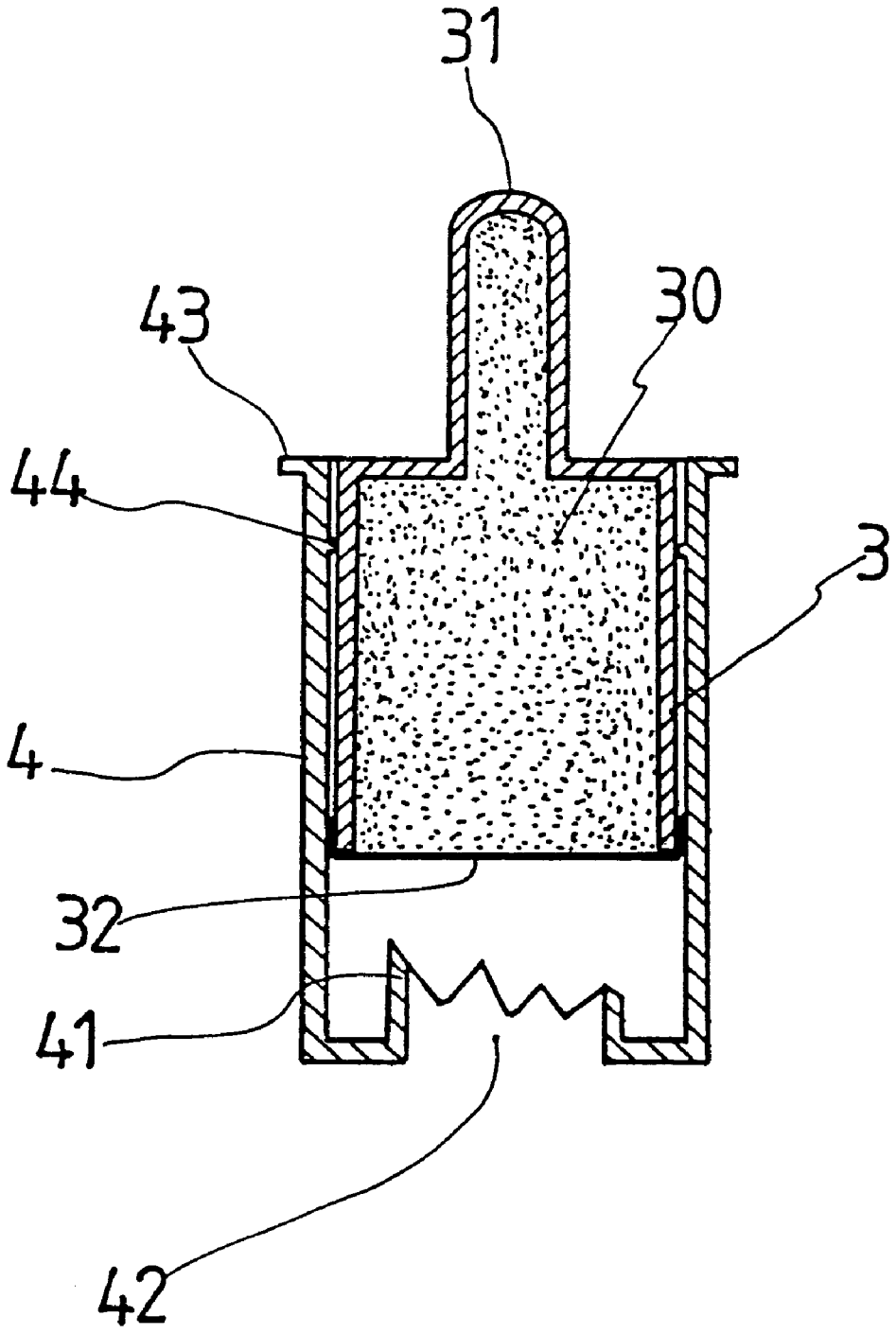
FIG. 3 a sectional view of the present invention.

As shown in FIGS. 1, 2 and 3 thereof, the tubular member 4 has an open top formed with a flange 43 and an open bottom with a toothed neck 41. The bottom of the tubular member 4 is formed with an opening 42 enclosed by the toothed neck 41. The tubular member 4 is dimensioned so that the tubular member 4 can be fitted in the mouth 51 of a PET bottle 5 with the flange 43 of the former resting on the upper edge of the mouth 51. The inner side of the tubular member 4 is formed with a circular protrusion 44. The container 3 is a closed cylinder formed with a handle 31 at the top thereof. The container 3 is fitted inside the tubular member 4 with the handle 31 extending upwardly out of the tular member 4. The container 3 is kept in place by the circular protrusion 44 of the tubular member 4. The locking cap 2 is formed with internal threads (shown but not numbered) engageable with external threads 52 on the mouth 51 of the PET bottle 5. The top of the locking cap 2 is formed with an axial through hole 21 for the passage of the handle 31 of the container 3. Further, the locking cap 2 has a an upwardly extending circular flange 22 dimensioned to engage with the end cap 1.

When in assembly, the tubular member 4 is first fitted inside the mouth 51 of the PET bottle 5 with the flange 43 of the former resting on the upper edge of the mouth 51 of the PET bottle. Then, the containter 3 is pushed in the tubular member 4 with the handle 31 extending upwardly out of the tubular member 4 and kept in place by the circular protrusion 44. Thereafter, the locking nut 2 is turned on to the mouth 51 of the PET bottle with the handle 31 going through the axial through hole 21. Finally, the en cap 1 is snugly-fitted on the circular flange 22 at the top of the locking cap 2.

Figure 4:
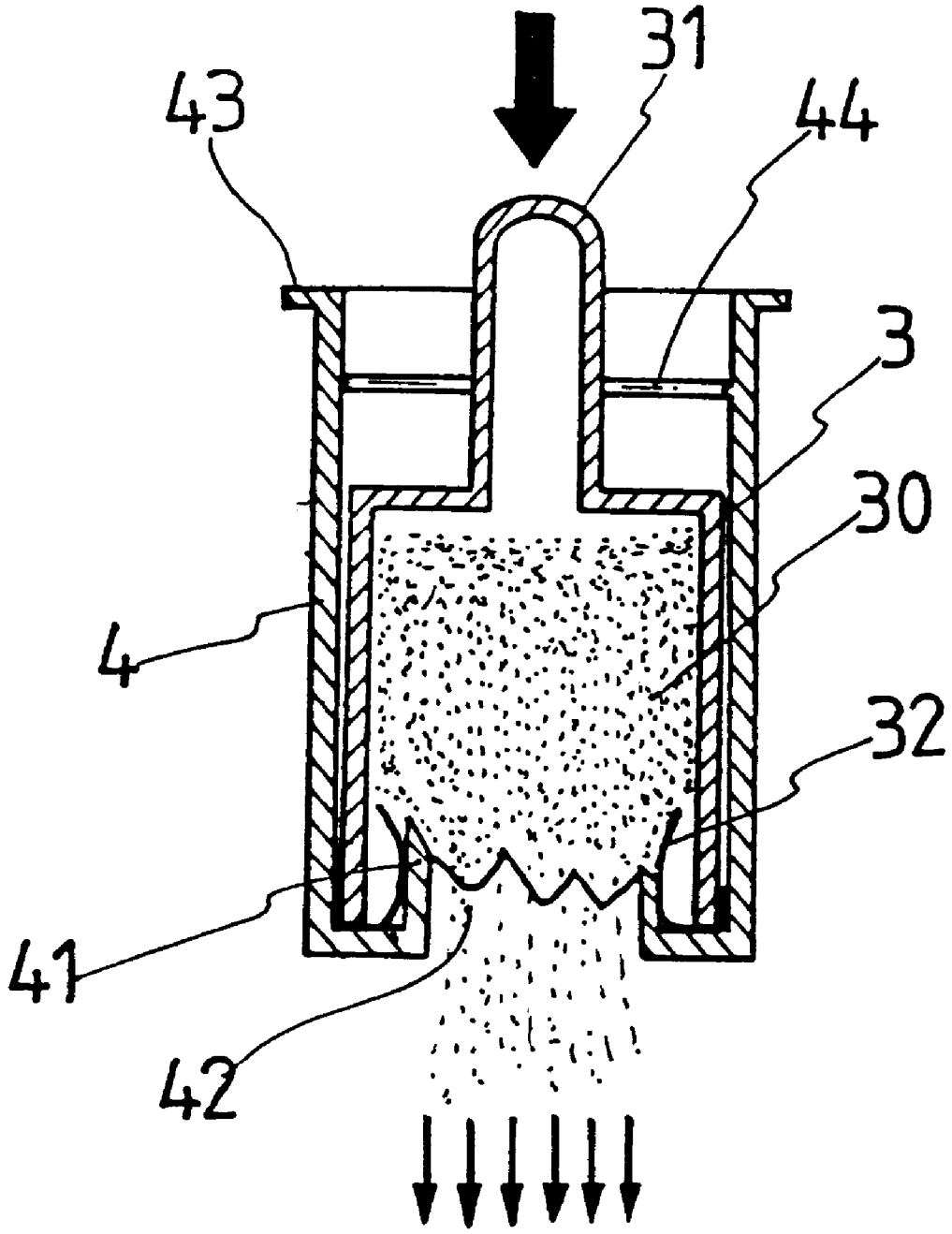
FIG. 4 illustrates how the cylinder is pierced by the present invention.
Figure 5:
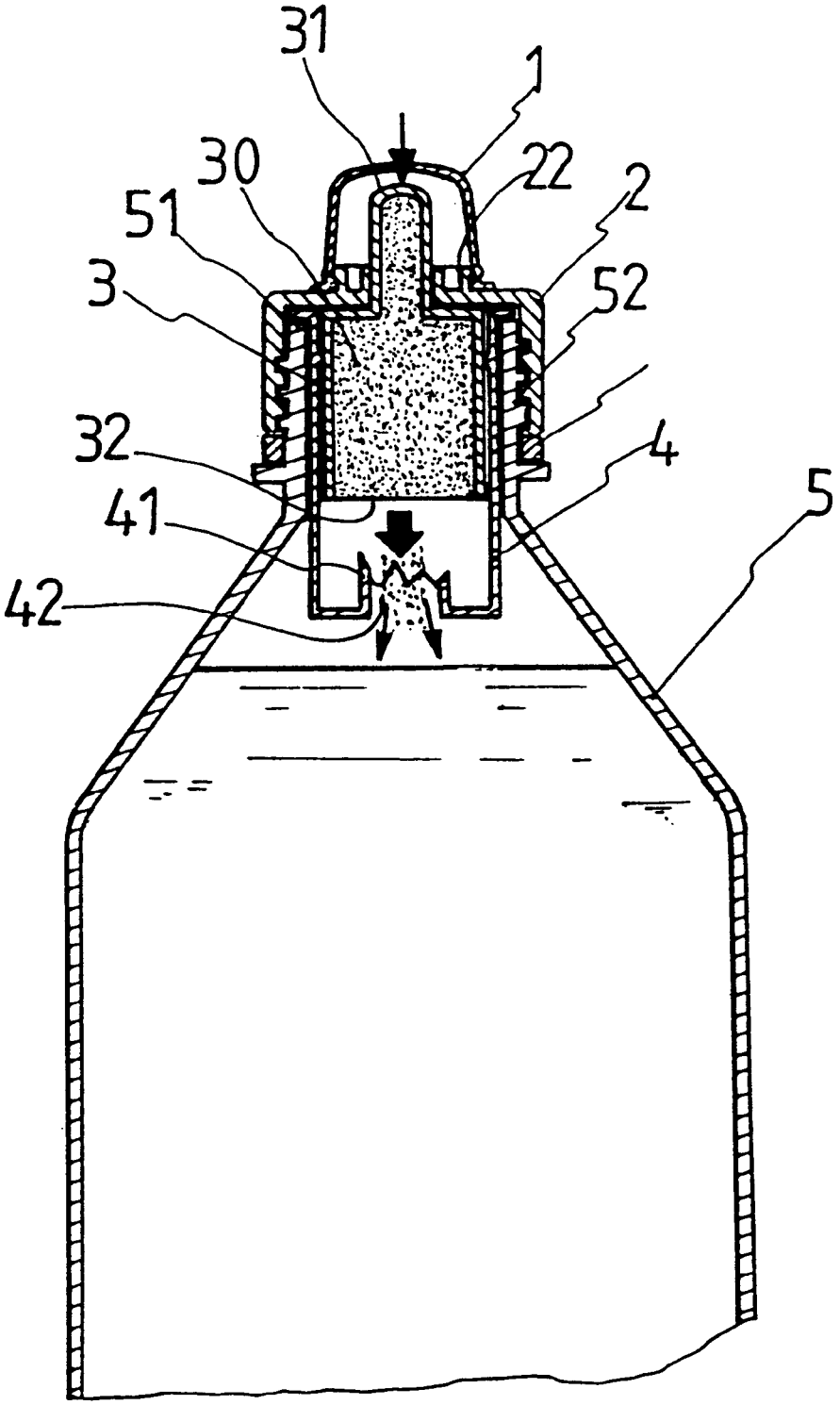
FIG. 5 illustrates the working principle of the present invention.
Figure 6:
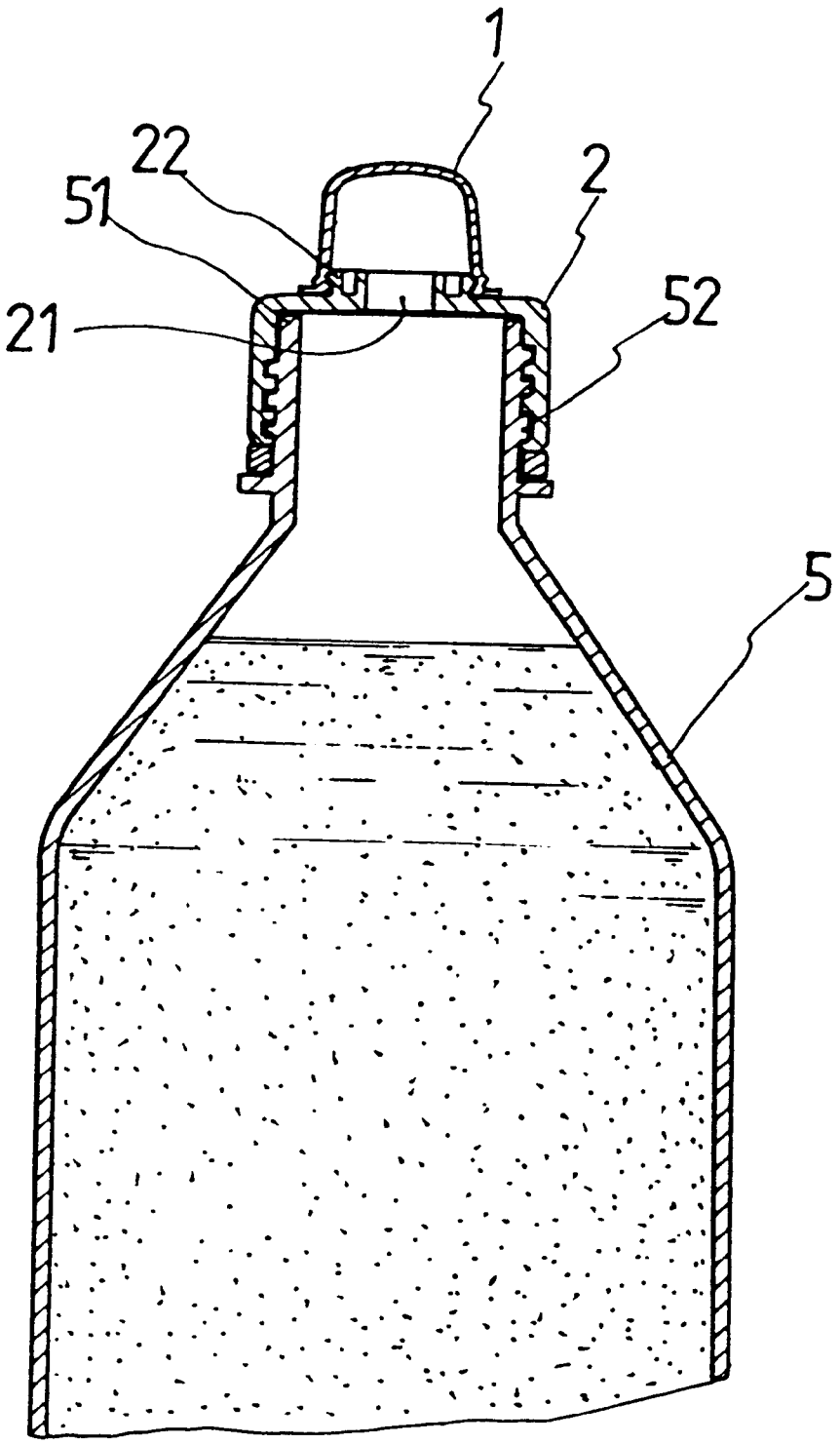
FIG. 6 is a sectional view of the present invention, with the container and the tubular member removed.

Referring to FIGS. 4 and 5, when desired to mix the additive such as sugar, cream milk, or the like in the container 3 with the drink in the PET bottle 5, it is only necessary to remove the end cap 1 and then depress the handle 31 downwardly to have the bottom of the container 3 pierced by the toothed neck 41 of the tubular member 4 thereby causing the additive 30 in the container 3 to drop down into the PET bottle 5. The amount of additive added into the PET bottle 5 is related to the area pierced through by the toothed neck 41 and so can be controlled by the depressing force on the handle 31. Then, the locking cap 2 is turned off to remove the tubular member 4 together with the container 3 to be served. The locking cap 2 may be turned on to the mouth 51 of the PET bottle and the end cap 1 may be engaged with the top of the locking cap to close the mouth 51 of the PET bottle.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. In a bottle with an externally threaded mouth in which is fitted an additive holder, said additive holder comprising:

a tubular member having an open top formed with a flange and an open bottom formed with a toothed neck, said tubular member being fitted in said externally threaded mouth with said flange resting on an upper edge of said mouth, said tubular member having an inner side formed with a circular protrusion;

a container having an upwardly extending handle and fitted inside said tubular member and kept in place by said circular protrusion, with said handle extending upwardly out of said tubular member;

a locking cap provided with internal threaded engageable with said externally threaded mouth and having an axial through hole receiving said handle of said container, said locking cap having an upwardly extending circular flange dimensioned to engage with said cover; and a cover engageable with a top of said locking cap.

* * * * *